US009586248B1

(12) United States Patent
Ghaleb et al.

(10) Patent No.: US 9,586,248 B1
(45) Date of Patent: Mar. 7, 2017

(54) SYSTEM FOR FORMING A T-SHAPED TUBULAR FITTING

(71) Applicant: KING SAUD UNIVERSITY, Riyadh (SA)

(72) Inventors: Atef Mohammed Abdo Ghaleb, Riyadh (SA); Mohamed Ali Eissa Saleh, Riyadh (SA); Adham Mohamed Azzat Ragab, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 15/094,999

(22) Filed: Apr. 8, 2016

(51) Int. Cl.
*B21C 37/29* (2006.01)
*B21D 26/037* (2011.01)

(52) U.S. Cl.
CPC ..... *B21C 37/29* (2013.01); *B21C 37/292* (2013.01); *B21D 26/037* (2013.01); *Y10T 29/49442* (2015.01)

(58) Field of Classification Search
CPC .. B23Q 3/06; B23Q 3/067; B23Q 3/68; B25B 13/44; B21C 37/29; B21C 37/292; Y10T 29/49426; Y10T 29/49442; B21D 26/037
See application file for complete search history.

(56) References Cited

U.S. PATENT DOCUMENTS 2,511,836 A * 6/1950 Lake Jr. ..... B21C 37/292 228/154
2,649,127 A * 8/1953 Lake, Jr. ..... B21C 37/292 29/890.11
3,210,984 A 10/1965 Arbogast
4,106,322 A 8/1978 Moshnin et al.
6,009,913 A 1/2000 Kojima et al.
6,044,683 A 4/2000 Shigemoto
6,151,937 A * 11/2000 Buccicone ..... B21D 22/105 72/57
6,430,812 B1 * 8/2002 Sanders ..... B21C 37/292 29/890.148
2008/0271512 A1 11/2008 Melgaard

FOREIGN PATENT DOCUMENTS

JP 2-290636 A 11/1990

* cited by examiner

*Primary Examiner* — Sarang Afzali
*Assistant Examiner* — Ruth G Hidalgo-Hernande
(74) *Attorney, Agent, or Firm* — Richard C. Litman

(57) ABSTRACT

The system for forming a T-shaped tubular fitting is configured for forming a T-shaped tubular part from an unbranched tubular part. The system includes an upper portion and a lower portion below the upper portion. A pushing block is disposed above the upper portion of the system. Compressible first and second side punches, respectively, extend from opposing sides of the upper portion. The upper portion includes a flat plate with a horizontal channel extending therethrough. The lower portion includes a housing with a vertical channel extending therethrough. The vertical channel extends normal to the horizontal channel. An insert can be disposed in the tubular part in alignment with the vertical channel. The horizontal channel and the vertical channel together define a T-shaped cavity. The T-shaped tubular fitting can be formed upon application of pressure to the pushing block.

5 Claims, 6 Drawing Sheets

SYSTEM FOR FORMING A T-SHAPED TUBULAR FITTING

FIELD OF THE INVENTION

The present invention relates to tube forming processes, and particularly to a system for forming T-shaped tubular fittings.

DESCRIPTION OF THE RELATED ART

Tubes are cylindrical structural elements typically used for retaining and manipulating fluids. The direction of fluid flow can be determined by tube branching. Tube branching involves the use of tube fittings of different shapes, e.g., "T", "Y", or "L" shape. T-shaped tubular fittings include two branches or arms with three ends, and are capable of directing fluid in three different directions.

Recently there has been an increasing demand for tubes having the T-shape configuration, such as in the automotive industry, the aerospace industries, and for household appliances. Various methods have been used for forming T-shaped tubular fittings with differing tube sizes (diameter, thickness and length), geometries of die cavity, and ratios of axial compression to internal pressure.

Welding and casting, as well as hydroforming are two such methods that are currently employed to form T-shaped tubular fittings. The welding and casting method requires more than one part to form the T-shaped tubular fitting and requires the use of additional weight. Hydroforming (hereinafter referred to as the "THF process"), involves the use of controlled internal pressure to expand a tube into a T-shape configuration.

Despite being one of the most widely used methods, the THF process has some drawbacks, such as slow cycle time, expensive special equipment, and limited applicability in both high pressure environments due to fluid leakage, as well as in high temperature environments due to low fluid evaporation and ignition temperature.

Thus, a system for forming T-shaped tubular fittings solving the aforementioned problems is desired.

SUMMARY OF THE INVENTION

The system for forming a T-shaped tubular fitting can form a T-shaped tubular part from an unbranched tubular part. The system includes an upper portion and a lower portion below the upper portion. A pushing block is disposed above the upper portion of the system. Compressible first and second side punches, respectively, extend from opposing sides of the upper portion. The upper portion includes a flat plate with a horizontal channel extending therethrough. The lower portion includes a housing with a vertical channel extending therethrough. The vertical channel extends normal to the horizontal channel. A tubular part can be positioned within the horizontal channel and an insert can be disposed in the tubular part in alignment with the vertical channel. The horizontal channel and the vertical channel together define a T-shaped cavity. The T-shaped tubular fitting can be formed upon application of pressure to the pushing block.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
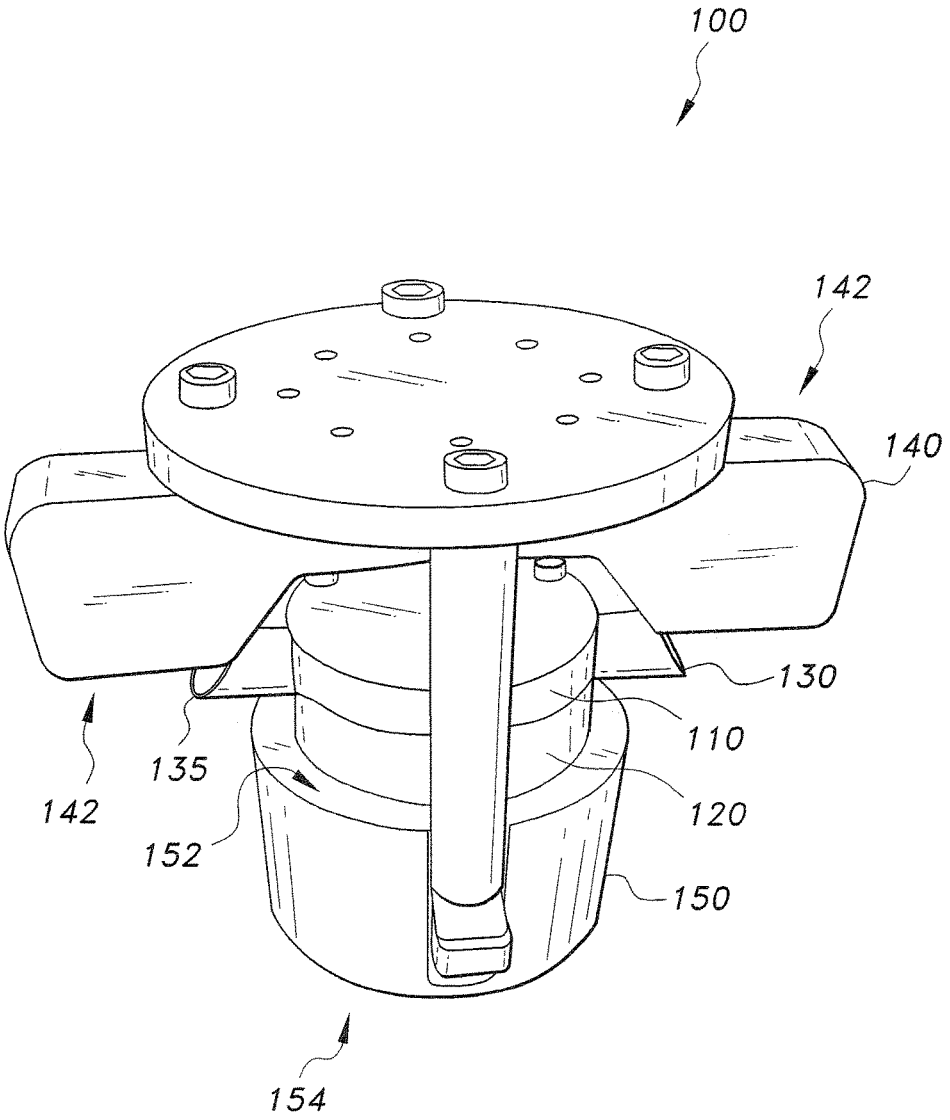
FIG. 1 is an environmental, perspective view of a system for forming a T-shaped tubular fitting, according to the present invention.

Referring to FIGS. 1 through 6, a die system for forming a T-shaped tubular fitting 100 is shown. The system 100 is configured for forming a T-shaped tubular part 330 (FIG. 3C) from a linear or unbrached tubular part 300. As shown in FIG. 1, the system 100 includes a first half or upper portion 110 and a second half or opposing lower portion 120 below the upper portion 110. A pushing block 140 can be disposed above the upper portion 110 of the system 100. Compressible first and second side punches 130 and 135, respectively, can extend from opposing sides of the upper portion 110.

Figure 2:
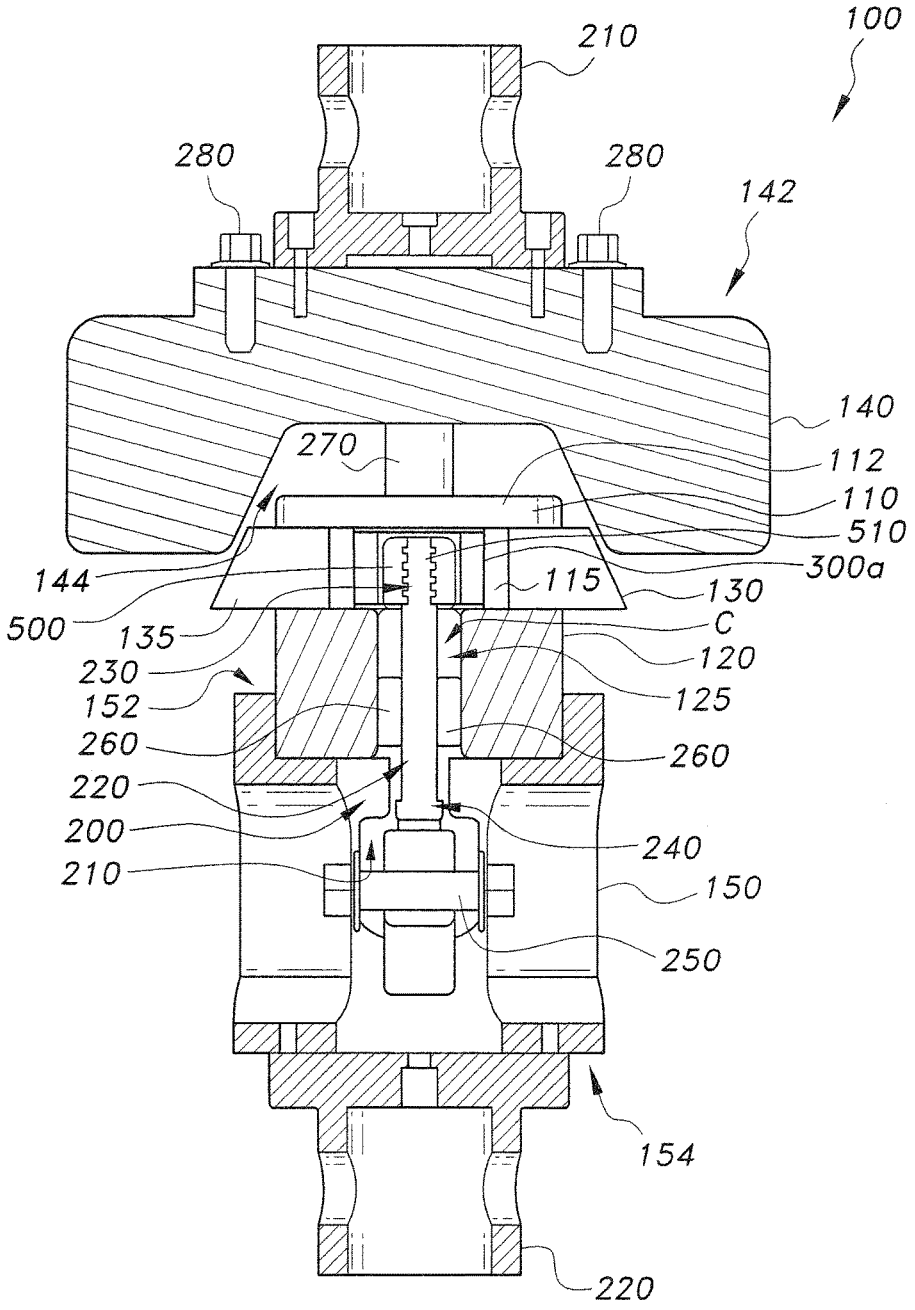
FIG. 2 is a cross section of the system for forming a T-shaped tubular fitting, according to the present invention.

As shown in FIG. 2, the upper portion 110 can include a flat plate 112 with a horizontal channel 115 extending therethrough. The lower portion 120 can include a housing 150 with a vertical channel 125 extending therethrough. The vertical channel 125 can extend normal to the horizontal channel 115. The horizontal channel 115 and the vertical channel 125 can together define a T-shaped cavity.

The linear tubular part 300 can have opposing first and second ends 300*a* and 300*b*, and a central aperture 310*a* between the first and second ends, 300*a* and 300*b*. The central aperture 310*a* is defined on a first surface 320 of the tubular part 300 and does not extend through both surfaces of the tubular part 300. The linear tubular part 300 can be positioned in the horizontal channel 115. The linear tubular part 300 can be positioned such that the central aperture 310*a* is aligned with the vertical channel 125. A removable insert 500 can be positioned in the tubular part 300, in alignment with the central aperture 310*a*. The insert 500 has an insert aperture 510.

A pull rod 220 can be disposed within the vertical channel 125. The pull rod 220 has a first end 230 and an opposing second end 240. The first end 230 of the pull rod 220 can be selectively disposed in the aperture 510 of the insert 500, e.g., the first end 230 can extend into aperture 510 when pressure is applied to the pushing block 140, as described in detail below. When disposed in the aperture 510, the first end 230 of the pull rod 220 engages an inner wall of the insert 500 and pulls the insert 500 into vertical channel 125. A U-joint 210, at a lower end of the second portion, can be coupled to the second end 240 of the pull rod 220. A pulling bracket 250 is coupled to the U-joint 210. One or more bearings 260 can be positioned between the pull rod 220 and the inner wall of the channel 125 to prevent friction between the pull rod 220 and the inner wall of the channel 125 when the pull rod 220 is moved within the channel 125.

The pushing block 140 includes a lower surface with a concave or recessed surface 144. A pushrod 270 can extend between and connect the upper portion and the pushing block 140. Compressible first and second side punches 130 and 135 are respectively positioned at opposing ends of the first horizontal channel for selectively communicating with the first and second ends 300*a* and 300*b* of the tubular part 330 positioned therein. In a non-compressed state, the first and second side punches 130 and 135 can be partially disposed within the horizontal channel 115 such that outer edges of the first and second side punches 130 and 135 extend beyond the horizontal channel 115. When the pushing block 140 is lowered, the first and second side punches 130 and 135 are pressed against the tubular part 330 by the lower surface 144 of the pushing block 140. The first and second side punches 130 and 135 communicate with the first and second ends 300*a* and 300*b* of the tubular part 330.

A first machine adapter 210 is coupled to an upper surface 142 of the pushing block 140 and a second machine adapter 220 is coupled to the lower surface 154 of the housing 150, as illustrated in FIG. 1. The machine adapters 210, 220 are configured for securing the system 100 to a machine, such as a common hydraulic press (not shown). The machine adapters 210, 220 can be secured to the top portion 142 of the pushing block 140 and the lower portion 154 of the housing 150, respectively, by any type of suitable fastener 280, such as screws.

Figure 3A:
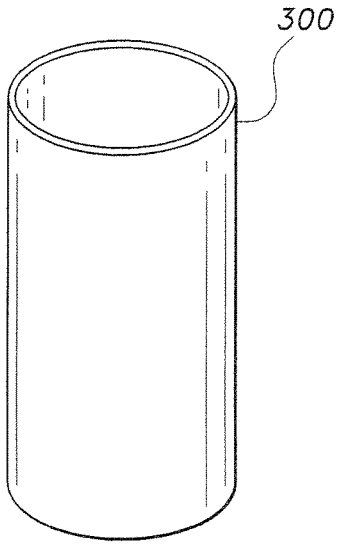
FIG. 3A illustrates an unbranched tube for the system for forming a T-shaped tubular fitting, according to the present invention.
Figure 3B:
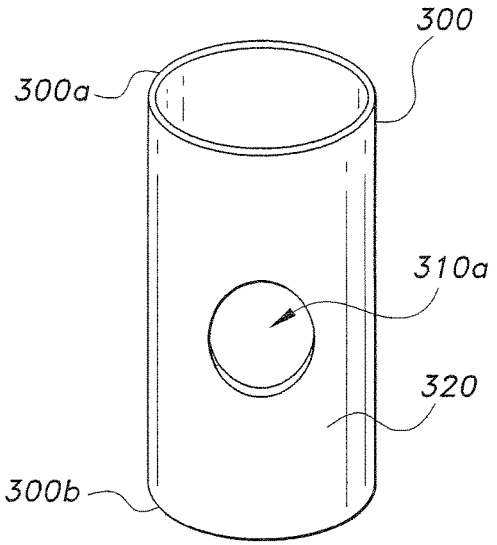
FIG. 3B is a front view of the unbranched tube having an opening along the mid-point of one surface of the tube for the system for forming a T-shaped tubular fitting, according to the present invention.
Figure 3C:
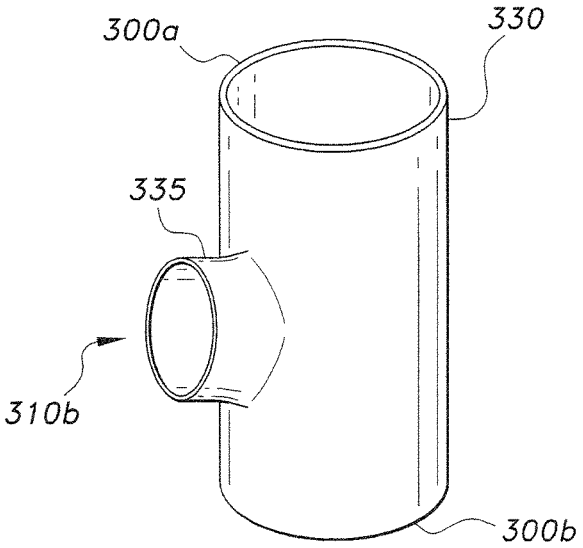
FIG. 3C is a side view of a T-shaped tubular fitting formed from the unbranched tube shown in FIGS. 3A and 3B, according to the present invention.
Figure 4:
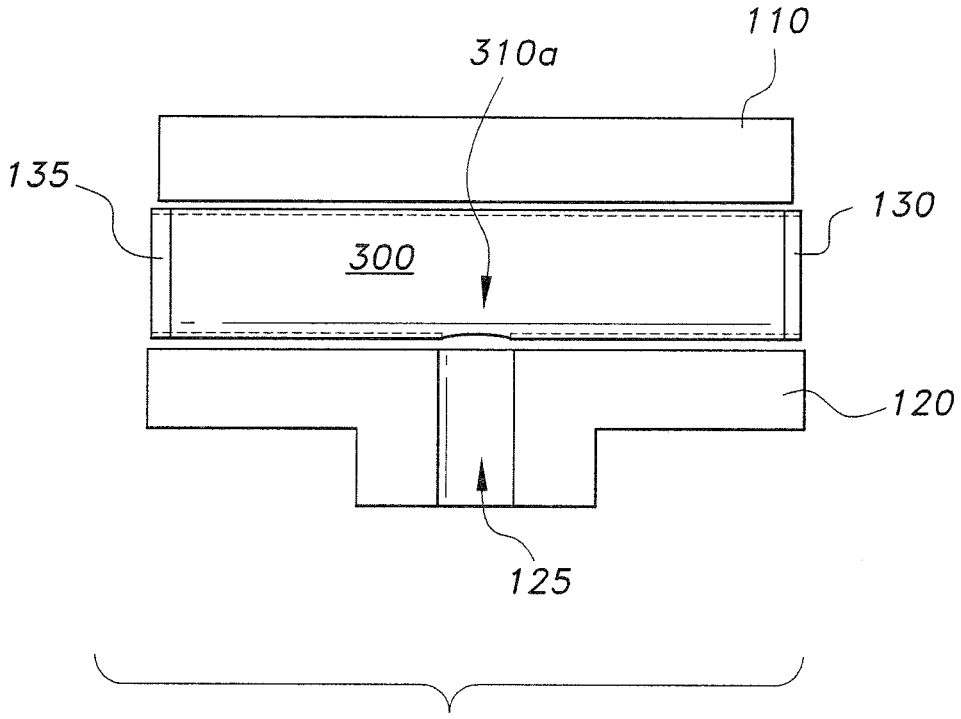
FIG. 4 is a schematic diagram of the system for forming a T-shaped tubular fitting, according to the present invention.

The pushing block 140 can be lowered upon application of pressure thereon. When pressure is applied to lower the pushing block 140, the first portion including the insert 500 is also lowered to allow the insert 500 to engage the pull rod and the first and second side punches 130 and 135 to engage the tubular part therebetween. In other words, the pushing block can move each side punch 130, 135 towards the tubular part 330*a* and thereby apply a predetermined amount of axial pressure to the opposing sides of the tubular part 300*a*. In addition, once the first end 230 of the pull rod 220 is inserted into the aperture 510 of the insert 500, the pull rod 220 can pull the insert 500 downward through the opening 310 of the tubular part, e.g., upon releasing pressure from the pushing block. When the insert is pulled into the vertical channel 125 a portion of the first tubular surface 320 is also pulled into the vertical channel, thereby forming the second arm 335 of the T-shaped tubular fitting 330 (FIG. 3C). Thus, lowering the pushing block can compress side punches 130, 135 to apply axial force on the tubular part 300, and allow the pull rod 220 to engage the insert 500. The pushing block 140 can be lowered by, for example, a common hydraulic press.

The components of the system 100 can be formed from any suitable material, such as from hardened D2 tool steel. The upper portion 110 and the opposing lower portion 120 can be configured as two separate parts, rather than as one integral piece, for easy removal of the T-shaped tubular part 330.

Figure 5A:
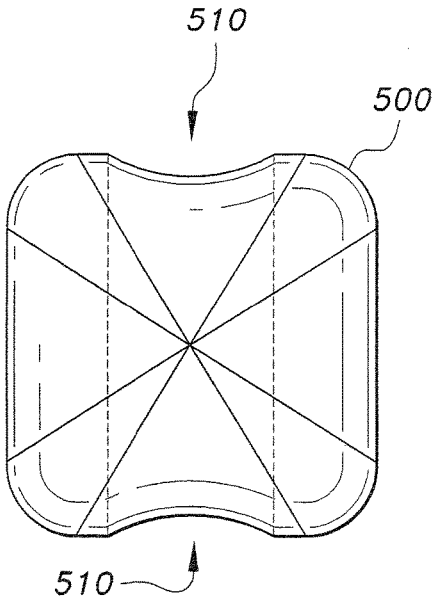
FIG. 5A is a front view of an insert for forming a T-shaped tubular fitting, according to the present invention.
Figure 5B:
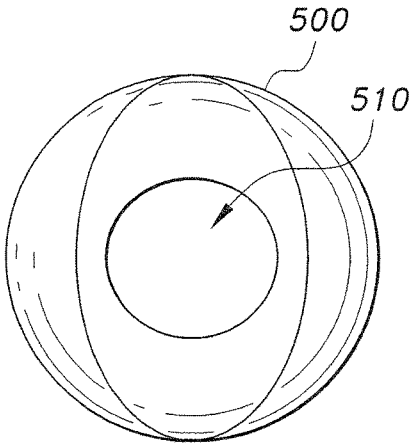
FIG. 5B is a top view of the insert for forming a T-shaped tubular fitting, according to the present invention.
Figure 5C:
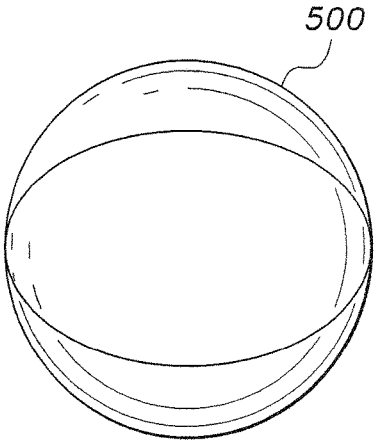
FIG. 5C is a side view of the insert for forming a T-shaped tubular fitting, according to the present invention.
Figure 5D:
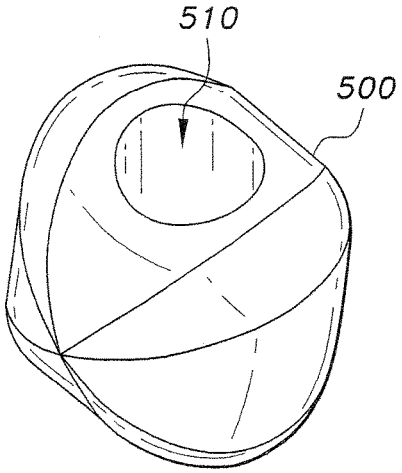
FIG. 5D is a three dimensional, perspective view of the insert for forming a T-shaped tubular fitting, according to the present invention.
Figure 6:
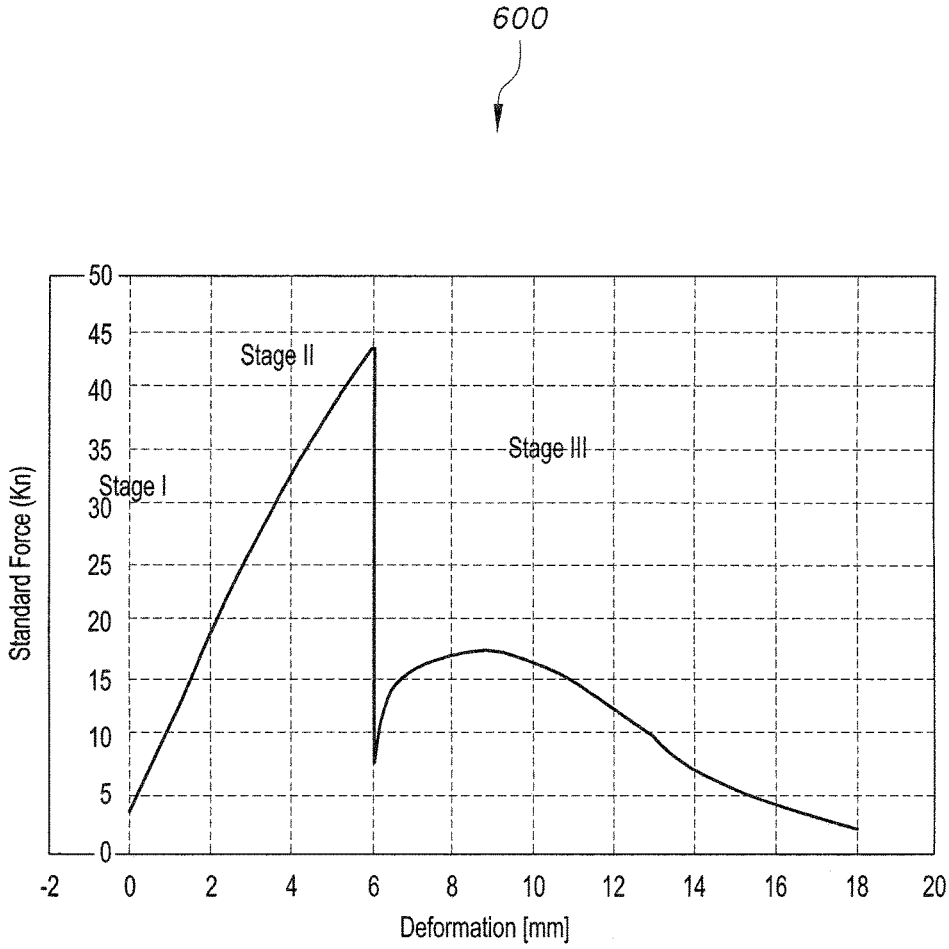
FIG. 6 is a load-displacement graph illustrating the three stages of forming a T-shaped tubular fitting, according to the present invention.

The insert 500 is preferably formed from a metal material, such as a hardened D2 tool steel. Other suitable materials, however, can be used to form the insert 500. The insert 500 can have any shape suitable for forming the second arm 335 of the T-shaped tubular part. Preferably, the insert 500 has a generally circular cross section, with a diameter that is larger than the diameter of the central aperture. FIGS. 5A and 5B illustrate a front view and a top view of an exemplary insert 500, respectively, for forming the second arm 335 of the T-shaped tubular fitting 330. FIGS. 5C and 5D illustrate a side view and perspective view, respectively, of the exemplary insert 500 for forming the second arm 335 of the T-shaped tubular fitting 330.

The linear tubular part 300 can be formed from any suitable metal material, e.g., copper, using any type of suitable machine, such as a lathe machine. The central opening in the tubular part 300 can be formed by, for example, drilling the outer surface 320 of the tube 300, such as at the mid-point of the tube 300, as illustrated in FIG. 3B. Once the tube 300 has been cut and the opening 310 drilled in the mid-point along the surface of the tube 300, the tube 300 can be heated and then cooled so as to remove the internal stresses of the tube 300 and toughen the tube 300. After the tube 300 has been prepared, each of the machine adapters 210, 220 can be fastened to an appropriate machine, such as a common hydraulic press.

The tube 300, as well as the upper portion 110 and the opposing lower portion 120 of the system 100 can then be lubricated to reduce friction between the tube 300 and the upper portion 110 and the opposing lower portion 120 of the system 100. The lubricant can be any suitable lubricant, such as a lubricant formed by mixing Castrol oil and fine silvery graphite powder.

The hydraulic press can be operated to lower the pushing block 140, as described above. When the pushing block 140 is lowered, axial force is applied to the two sides of the tube 300 by the punches, and the insert 500 can, e.g., simultaneously, be pulled downward by the pull rod 220. This can cause the second arm 335 of the T-shape tubular fitting 330 to begin to appear, represented as Stage 2 in FIG. 6. In Stage 3, the insert 500 can be pulled further in a downward vertical direction until the insert 500 is completely out of the tube 300 and the second arm 335 having the large opening 310*b* of the T-shape tubular fitting 330 is formed, as illustrated in FIG. 3C.

It is to be understood that the present invention is not limited to the embodiments described above, but encompasses any and all embodiments within the scope of the following claims.

We claim:

1. A system for forming a T-shaped tubular fitting, the system comprising:

an upper portion and an opposing lower portion, the upper portion including a horizontal channel extending therethrough, the lower portion including a vertical channel extending therethrough, the vertical channel being normal to the horizontal channel, the horizontal channel and the vertical channel together defining a T-shaped cavity;

a pushing block disposed over the upper portion, the pushing block including a concave lower surface;

a tubular part configured for fitting within the horizontal channel, the tubular part having an aperture in a surface thereof;

a first side punch and a second side punch positioned in the horizontal channel, the first side punch being adjacent one end of the tubular part and the second side punch being adjacent an opposing end of the tubular part;

the first and second side punches having a tapered outer edge;

wherein the concave lower surface of the pushing block engages the tapered outer edges of the first and second side punches;

whereby upon vertical movement of the pushing block causes horizontal movement of the first and second punches;

an insert having an aperture, the insert configured for positioning within the tubular part;

a pull rod positioned within the vertical channel of the lower portion, the pull rod having a first end and an opposing second end; and a push rod extending between the pushing block and the upper portion.

2. The system for forming a T-shaped tubular fitting according to claim 1, further comprising a first machine adapter coupled to the upper portion of the pushing block and a second machine adapter coupled to the lower portion of the housing, the machine adapters configured for connecting the system to a hydraulic press.

3. The system for forming a T-shaped tubular fitting according to claim 1, wherein the insert aperture is configured to receive the first end of the pull rod.

4. The system for forming a T-shaped tube fitting according to claim 1, further comprising:

a U-joint coupled to the opposing second end of the pull rod; and a pulling bracket coupled to the U-joint, the pulling bracket configured for pulling the pull rod in a vertical direction so as to pull the insert out of the tube to form the second arm of the T-shaped tube fitting.

5. The system for forming a T-shaped tube fitting according to claim 1, further comprising a plurality of bearings between the pull rod and an inner wall of the vertical channel.

* * * * *